US011852031B2

(12) United States Patent
Pelc et al.

(10) Patent No.: US 11,852,031 B2
(45) Date of Patent: Dec. 26, 2023

(54) CONDUIT BRACKET FOR A GAS TURBINE ENGINE

(71) Applicant: Pratt & Whitney Canada Corp., Longueuil (CA)

(72) Inventors: Mateusz Pelc, Rzeszow (PL); Julien Girard, Saint-Julie (CA)

(73) Assignee: Pratt & Whitney Canada Corp., Longueuil (CA)

( * ) Notice: Subject to any disclaimer, the term of this patent is extended or adjusted under 35 U.S.C. 154(b) by 126 days.

(21) Appl. No.: 17/392,710

(22) Filed: Aug. 3, 2021

(65) Prior Publication Data

US 2023/0043298 A1 Feb. 9, 2023

(51) Int. Cl.
*F01D 25/28* (2006.01)

(52) U.S. Cl.
CPC ..... *F01D 25/28* (2013.01)

(58) Field of Classification Search
CPC ..... F01D 25/243; F01D 25/28; F01D 25/14; F01D 25/24; F01D 25/30; F01D 25/04; F05D 2240/14; F05D 2260/21
See application file for complete search history.

(56) References Cited

U.S. PATENT DOCUMENTS 4,441,323 A * 4/1984 Colley ..... F23R 3/283 60/737
5,313,780 A 5/1994 Williams
5,369,952 A 12/1994 Walters
5,771,696 A * 6/1998 Hansel ..... F23R 3/283 60/746
7,669,424 B2 * 3/2010 Thornton ..... F23R 3/283 277/606
2005/0271494 A1 12/2005 Hidalgo
2010/0132371 A1 6/2010 Durocher
2018/0355762 A1 12/2018 Tripodina
2020/0025005 A1 1/2020 Dunnigan
2020/0109643 A1 4/2020 Silva

OTHER PUBLICATIONS

EP search report for EP22188275.6 dated Dec. 6, 2022.

* cited by examiner

*Primary Examiner* — David E Sosnowski
*Assistant Examiner* — Maxime M Adjagbe
(74) *Attorney, Agent, or Firm* — Getz Balich LLC

(57) ABSTRACT

An assembly is provided for a turbine engine. This turbine engine assembly includes a static structure, a conduit and a bracket. The static structure includes a port. The conduit extends longitudinally through the port. The bracket couples the conduit to the static structure. The bracket includes a first base mount, a second bade mount, a conduit mount, a first damper and a second damper. The first base mount is attached to the static structure. The second base mount is attached to the static structure. The conduit mount is mechanically coupled with the conduit. The first damper is between the first base mount and the conduit mount. The second damper is between the second base mount and the conduit mount.

13 Claims, 9 Drawing Sheets

CONDUIT BRACKET FOR A GAS TURBINE ENGINE

BACKGROUND OF THE DISCLOSURE

1. Technical Field

This disclosure relates generally to a turbine engine and, more particularly, to arranging a conduit with a static structure of the turbine engine.

2. Background Information

A gas turbine engine may include a static structure and a fluid conduit which passes radially through the static structure from an exterior of the static structure to an interior of the static structure. A bracket may be connected to the static structure and the fluid conduit for preventing large displacements between the static structure and the fluid conduit. While known brackets have various advantages, there is still room in the art for improvement. For example, slight rubbing between the bracket and the fluid conduit may cause damage (e.g., fretting) to the fluid conduit.

SUMMARY OF THE DISCLOSURE

According to an aspect of the present disclosure, an assembly is provided for a turbine engine. This turbine engine assembly includes a static structure of the turbine engine, a conduit and a bracket. The static structure includes a port. The conduit extends longitudinally through the port. The bracket couples the conduit to the static structure. The bracket includes a first base mount, a second base mount, a conduit mount, a first damper and a second damper. The first base mount is attached to the static structure. The second base mount is attached to the static structure. The conduit mount is mechanically coupled with the conduit. The first damper is between the first base mount and the conduit mount. The second damper is between the second base mount and the conduit mount.

According to another aspect of the present disclosure, another assembly is provided for a turbine engine. This turbine engine assembly includes a static structure of the turbine engine, a conduit and a bracket. The static structure includes a port. The conduit extends longitudinally through the port. The bracket couples the conduit to the static structure. The bracket includes a first bracket finger, a second bracket finger and a conduit mount attached to the conduit. The first bracket finger is configured with a channeled sectional geometry when viewed in a plane. The first bracket finger is configured as or otherwise includes a first base mount attached to the static structure. The second bracket finger is configured with a channeled sectional geometry when viewed in the plane. The second bracket finger is configured as or otherwise includes a second base mount attached to the static structure.

According to still another aspect of the present disclosure, a bracket is provided for mounting a conduit to a component of a turbine engine. This bracket includes a first bracket finger, a second bracket finger and a conduit mount. The first bracket finger is configured as or otherwise includes a first base mount. The first base mount is configured to mechanically fasten to the component. The second bracket finger is configured as or otherwise includes a second base mount. The second base mount is configured to mechanically fasten to the component. The conduit mount includes a port configured to receive the conduit. The conduit mount is configured to mechanically couple with the conduit. The bracket mount is configured with a first side channel, a second side channel and an intermediate channel. The first side channel is formed by the first bracket finger. The first side channel extends longitudinally into the bracket along a first longitudinal direction. The second side channel is formed by the second bracket finger. The second side channel extends longitudinally into the bracket along the first longitudinal direction. The intermediate channel is formed laterally between the first bracket finger and the second bracket finger. The intermediate channel extends longitudinally into the bracket along a second longitudinal direction to the conduit mount. The second longitudinal direction is opposite the first longitudinal direction.

The turbine engine assembly may also include a conduit fixture fluidly coupled to an end of the conduit. The conduit fixture may be attached to the conduit mount. The conduit mount may include a second port. The conduit may project longitudinally through the second port.

The first bracket finger may also include a bridge leg and an offset leg. The bridge leg may extend laterally between and/or may be connected to the first base mount and the offset leg. The offset leg may extend longitudinally between and/or may be connected to the bridge leg and the conduit mount.

The bracket may be configured with a first side channel, a second side channel and an intermediate channel. The first side channel may be formed by the first bracket finger. The first side channel may extend longitudinally into the bracket along a first longitudinal direction. The second side channel may be formed by the second bracket finger. The second side channel may extend longitudinally into the bracket along the first longitudinal direction. The intermediate channel may be formed laterally between the first bracket finger and the second bracket finger. The intermediate channel may extend longitudinally into the bracket along a second longitudinal direction that is opposite the first longitudinal direction.

The static structure may include a turbine engine case through which the port extends. The static structure may also include a first structure mount and a second structure mount. The first structure mount may be connected to a base of the turbine engine case. The first base mount may be mechanically fastened to the first structure mount. The second structure mount may be connected to the base of the turbine engine case. The second base mount may be mechanically fastened to the second structure mount.

The first structure mount may be configured as a flange of the turbine engine case.

The first structure mount may be configured as a boss of the turbine engine case.

The conduit mount may include a second port. The conduit may project longitudinally through the second port.

The turbine engine assembly may also include a conduit fixture fluidly coupled to an end of the conduit. The conduit fixture may be mechanically fastened to the conduit mount.

The conduit mount may be non-perpendicular to the first base mount.

The first damper may include a lateral leg and a longitudinal leg. The lateral leg may extend laterally between and/or may be connected to the first base mount and the longitudinal leg. The longitudinal leg may extend longitudinally between and/or may be connected to the lateral leg and the conduit mount.

The longitudinal leg may longitudinally overlap the first base mount.

The longitudinal leg may be parallel with the first base mount.

The longitudinal leg may be non-parallel with the first base mount.

The lateral leg may include a first segment and a second segment. The first segment may be connected between the first base mount and the second segment. The first segment may be angularly offset from the first base mount by a first obtuse angle. The second segment may be angularly offset from the first segment by a second obtuse angle.

The second segment may be angularly offset from the longitudinal leg by an included angle between seventy degrees and one-hundred and ten degrees.

The longitudinal leg may include a first segment and a second segment. The second segment may be connected between the conduit mount and the first segment. The second segment may be angularly offset from the conduit mount by a first obtuse angle. The second segment may be angularly offset from the first segment by a second obtuse angle.

At least the first base mount, the second base mount, the conduit mount, the first damper and the second damper may be configured together as a monolithic body.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
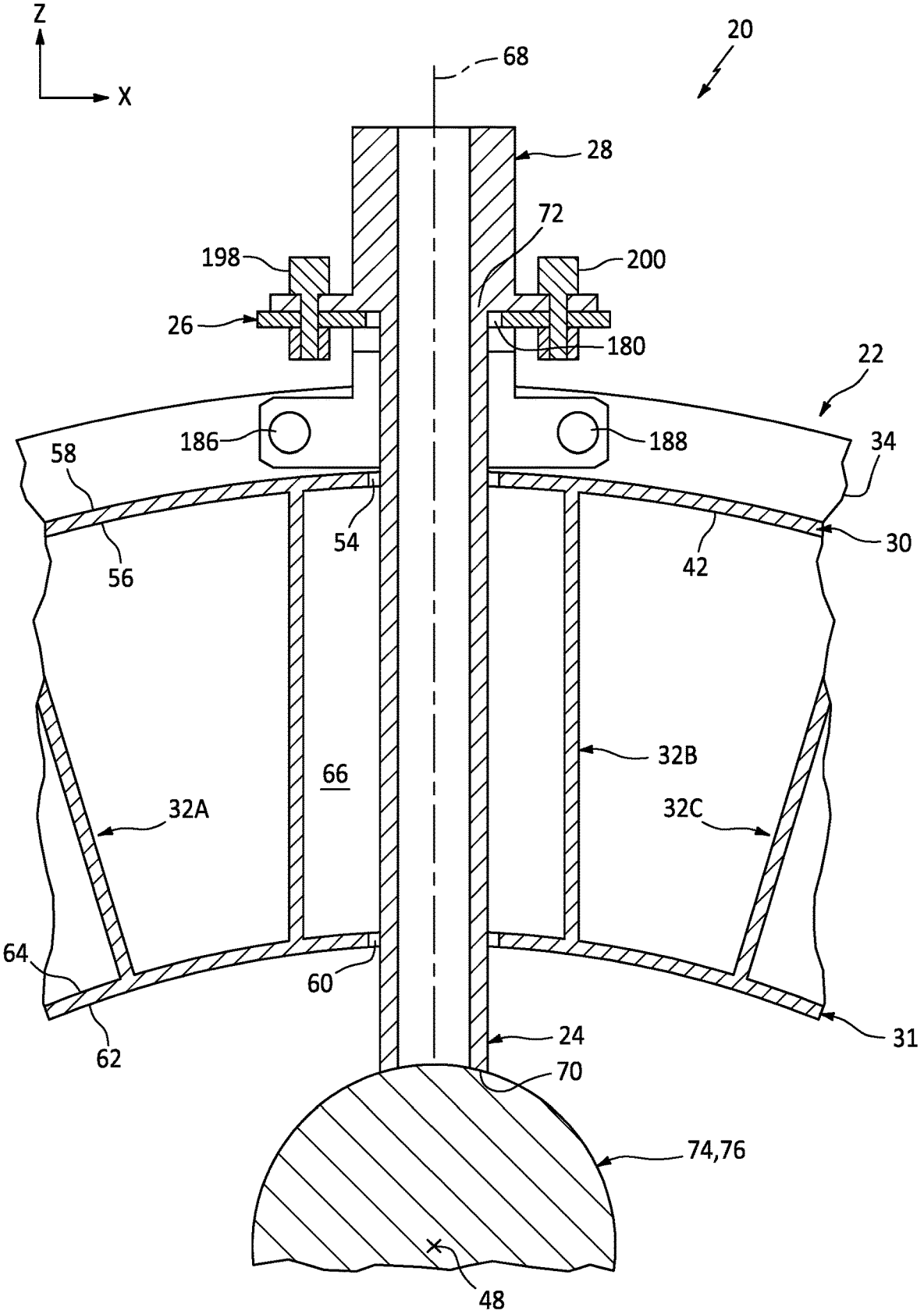
FIG. 1 is a schematic cross-sectional illustration of a portion of an assembly for a turbine engine.

FIG. 1 illustrates an assembly 20 for a turbine engine. This turbine engine assembly 20 includes a static structure 22, a fluid conduit 24 (e.g., a lubricant and/or coolant conduit) and a conduit bracket 26. The turbine engine assembly 20 of FIG. 1 also includes a fixture 28 (e.g., a fitting, coupling, etc.) for the fluid conduit 24.

The static structure 22 may be any static (e.g., stationary) structure of the turbine engine. The static structure 22, for example, may be configured as or otherwise include a turbine exhaust case (TEC). In another example, the static structure 22 may be configured as or otherwise include a turbine support structure (e.g., a mid-turbine frame) or a compressor support structure (e.g., a mid-compressor frame). In still another example, the static structure 22 may be configured as a simple case or wall of the turbine engine through which the fluid conduit 24 may pass. The present disclosure, of course, is not limited to the foregoing exemplary static structure configurations.

The static structure 22 of FIG. 1 includes an outer turbine engine case 30 ("outer case"), an inner turbine engine case 31 ("inner case") and one or more turbine engine vanes (e.g., 32A-C; generally referred to as "32"); e.g., hollow guide vanes. The static structure 22 of FIG. 2 also includes one or more structure mounts 34 and 36 for the conduit bracket 26. For ease of description, the structure mounts 34 and 36 may be described below as flanges 38 and 40 connected to (e.g., formed integral with) and projecting radially out from a (e.g., tubular) base 42 of the outer case 30. However, it is contemplated one or each of the structure mounts 34 and 36 may alternatively be configured as or otherwise include another component of the static structure 22. For example, referring to FIG. 3, one or each of the structure mounts 34 and 36 may alternatively be configured as or otherwise include a mounting boss 44, 46 connected to (e.g., formed integral with) and projecting radially out from the outer case base 42. In another example, one or each of the structure mounts 34 and 36 may alternatively be configured as or otherwise include another bracket (e.g., a mounting bracket) connected to outer case base 42.

Figure 2:
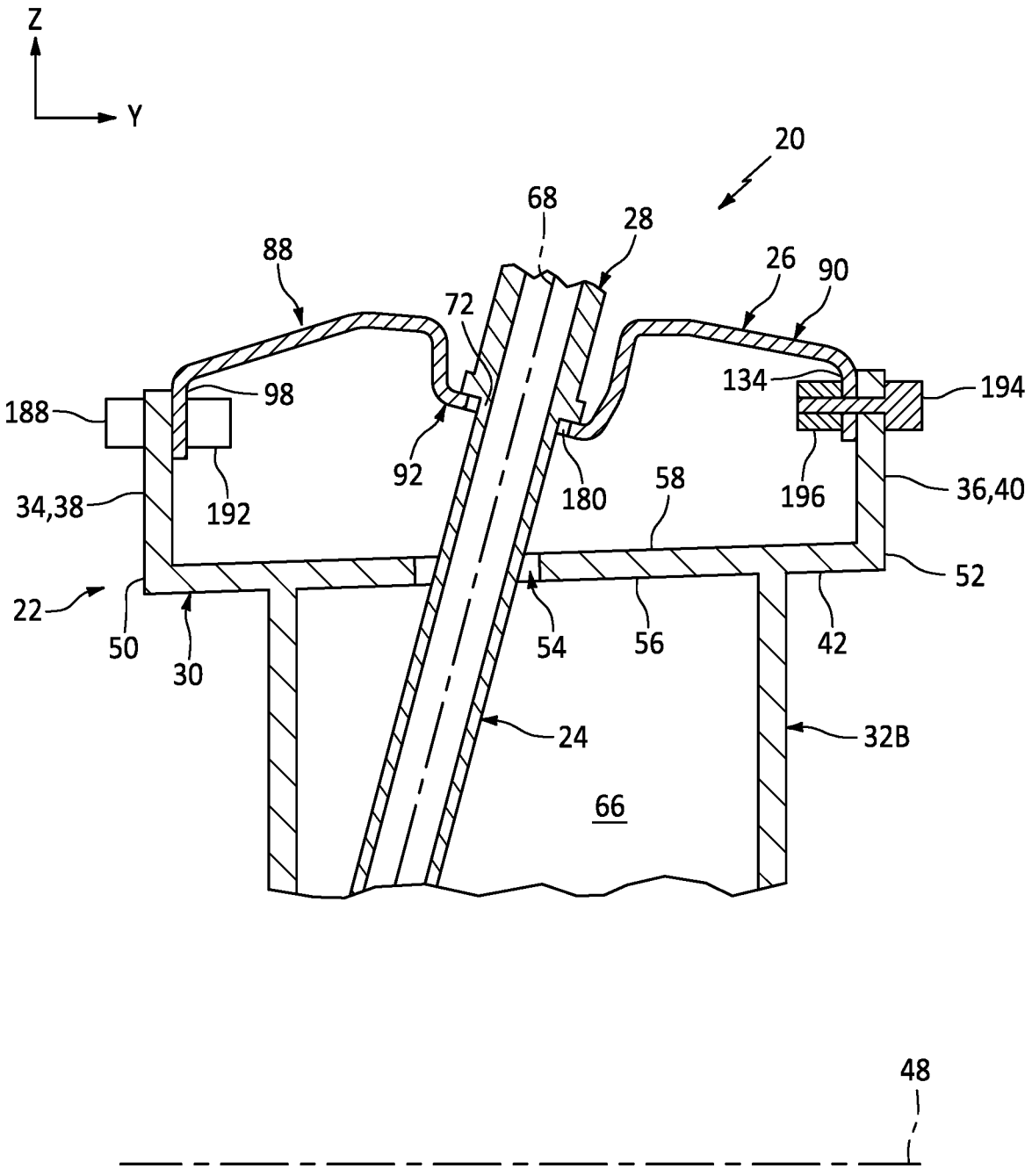
FIG. 2 is a schematic sectional illustration of another portion of the turbine engine assembly.
Figure 3:
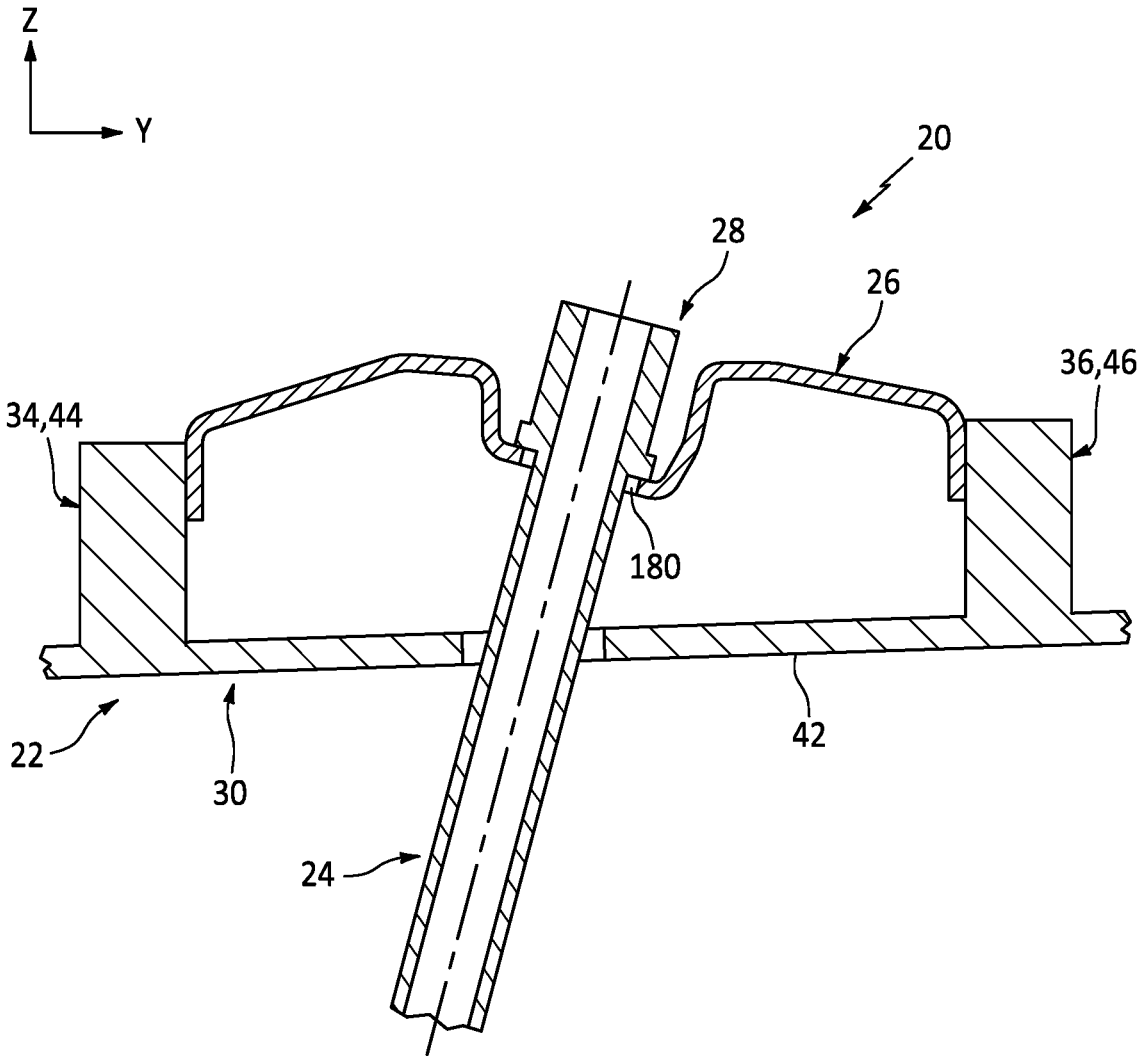
FIG. 3 is a schematic sectional illustration of another portion of the turbine engine assembly configured with alternative structure mounts.

The outer case 30 and its base 42 of FIG. 1 extend circumferentially about (e.g., completely around) an axial centerline 48, which axial centerline 48 may also be a rotational axis for one or more components within the turbine engine. The outer case 30 and its base 42 of FIG. 2 extend axially along the axial centerline 48 of the turbine engine between a first (e.g., forward, upstream) end 50 of the outer case 30 and a second (e.g., aft, downstream) end 52 of the outer case 30. The outer case 30 of FIGS. 1 and 2 includes the outer case base 42, the first structure mount 34, the second structure mount 36 and an outer case port 54; e.g., an aperture such as a through-hole. The first structure mount 34 of FIG. 2 is disposed at (e.g., on, adjacent or proximate) the outer case first end 50. The second structure mount 36 of FIG. 2 is disposed at the outer case second end 52. The outer case port 54 of FIGS. 1 and 2 extends radially through the outer case 30 between an inner side 56 of the outer case 30 and an outer side 58 of the outer case 30.

The inner case 31 of FIG. 1 extends axially along and circumferentially about (e.g., completely around) the axial centerline 48. The inner case 31 of FIG. 1 includes an inner case port 60; e.g., an aperture such as a through hole. This inner case port 60 extends radially through the inner case 31 between an inner side 62 of the inner case 31 and an outer side 64 of the inner case 31. The inner case port 60 may be (e.g., axially and/or circumferentially) aligned with the outer case port 54. For example, a centerline of the inner case port 60 may be coaxial with a centerline of the outer case port 54; however, the present disclosure is not limited thereto.

The vanes 32 of FIG. 1 are arranged circumferentially about the axial centerline 48 in an annular array. This annular array of the vanes 32 is disposed radially between the outer case 30 and the inner case 31. Each of the vanes 32 of FIG. 1 extends radially between and is connected to the outer case 30 and the inner case 31. Each of the vanes 32 of FIG. 1 is configured as a hollow vane. Each of the vanes 32 of FIG. 1, for example, has a vane passage 66 (e.g., bore) which extends radially through the respective vane 32. The vane passage 66 of a first of the vanes 32B ("first vane") is (e.g., axially and/or circumferentially) aligned with the outer case port 54 and the inner case port 60. The first vane passage 66 is thereby radially between and fluidly coupled with the outer case port 54 and the inner case port 60. Of course, in other embodiments, the outer case port 54 and/or the inner case port 60 may each be configured as an extension of the first vane passage 66 through the static structure 22.

The fluid conduit 24 extends longitudinally along a longitudinal centerline 68 of the fluid conduit 24 between and to an inner end 70 of the fluid conduit 24 and an outer end 72 of the fluid conduit 24. The conduit inner end 70 is connected to an inner structure 74 of the turbine engine (schematically shown). The conduit inner end 70, for example, may be connected (e.g., welded, brazed and/or otherwise bonded) to and fluidly coupled with a bearing support structure 76. The fluid conduit 24 projects longitudinally along its longitudinal centerline 68 out from its inner end 70, sequentially through the apertures 60, 66 and 54, to the conduit fixture 28 at the conduit outer end 72. The fluid conduit 24 may thereby pass (e.g., radially relative to the axial centerline 48) from an interior of the static structure 22 to an exterior of the static structure 22.

The conduit bracket 26 of FIG. 1 is configured to provide a damped mechanical coupling between the fluid conduit 24 and the static structure 22. The conduit bracket 26, for example, is configured to damp transmission of vibrations between the fluid conduit 24 and the static structure 22, while still allowing slight relative movement between the fluid conduit 24 and the static structure 22. The conduit bracket 26 is also configured to reduce or prevent unintended contact (e.g., rubbing) between the fluid conduit 24 and other components of the turbine engine assembly 20; e.g., 22 and 30. Note, the fluid conduit 24 may float within the apertures 54, 60 and 66 so as not to contact the components 22, 30 and 31.

Referring to FIGS. 4-7, the conduit bracket 26 extends longitudinally in the longitudinal direction (e.g., a z-axis direction) generally along a z-axis (e.g., along the longitudinal centerline 68) between and to an inner side 78 of the conduit bracket 26 and an outer side 80 of the conduit bracket 26. The conduit bracket 26 extends laterally in a first lateral direction (e.g., an x-axis direction) along an x-axis (e.g., circumferentially or tangentially relative to the axial centerline 48) between and to opposing lateral sides 82 and 84 of the conduit bracket 26. The conduit bracket 26 extends laterally in a second lateral direction (e.g., a y-axis direction) along a y-axis (e.g., axially relative to the axial centerline 48) between and to opposing ends 86 and 88 of the conduit bracket 26. Note, the term "lateral" may be used herein to generally describe the first lateral direction, the second lateral direction and/or any other direction within the x-y plane.

Figure 4:
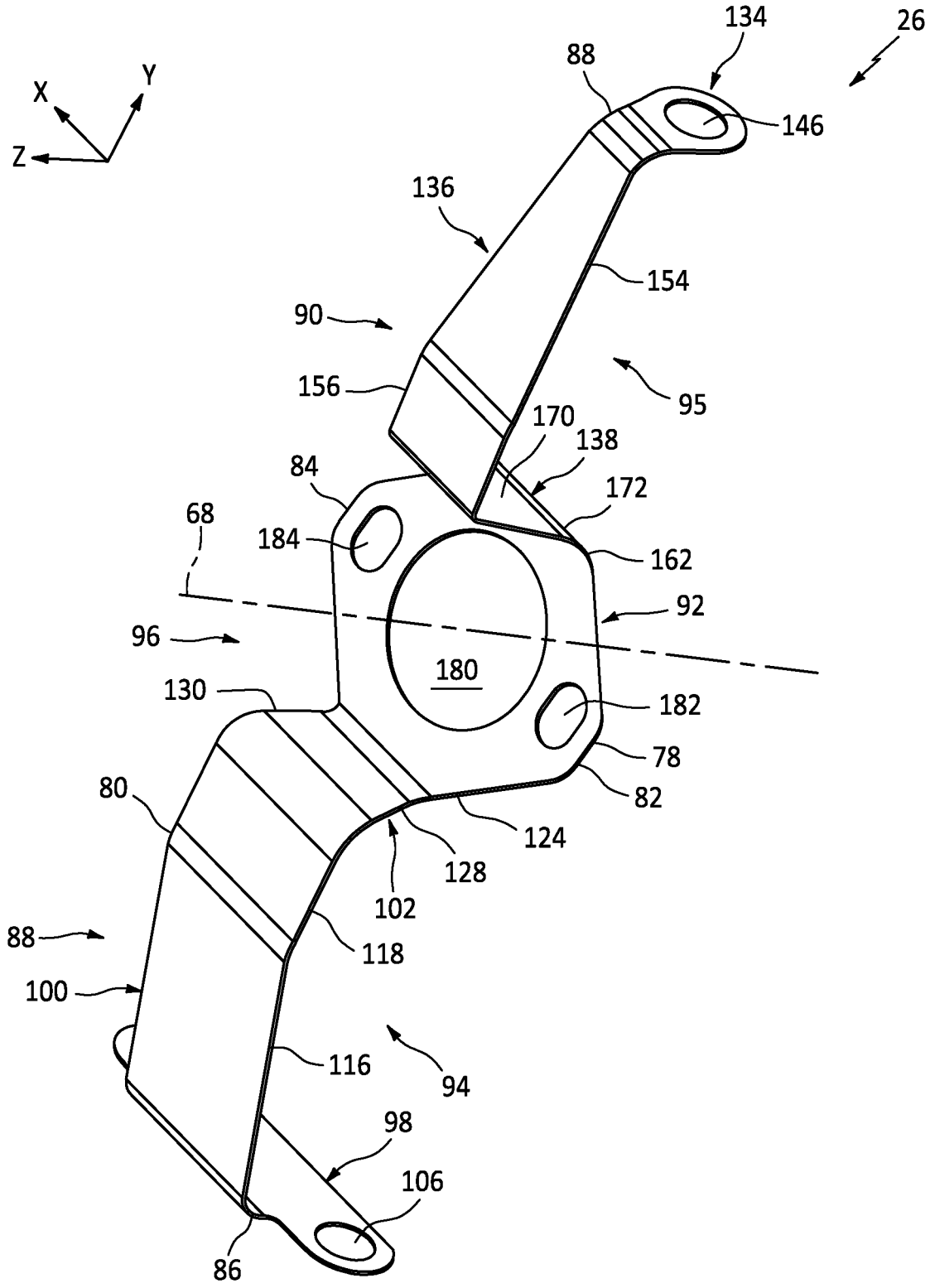
FIGS. 4-7 are illustrations of different views of a conduit bracket.
Figure 5:
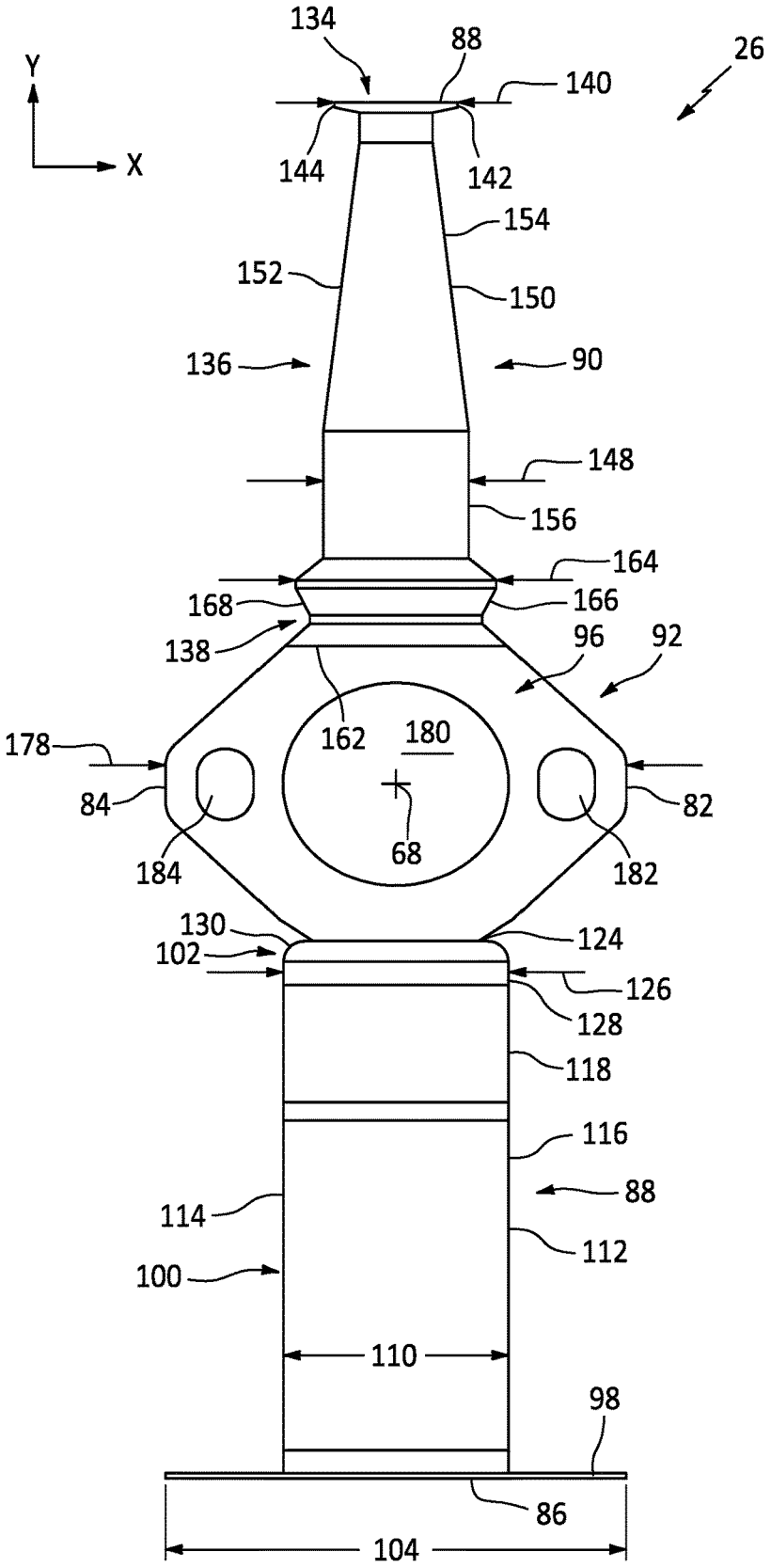
Figure 6:
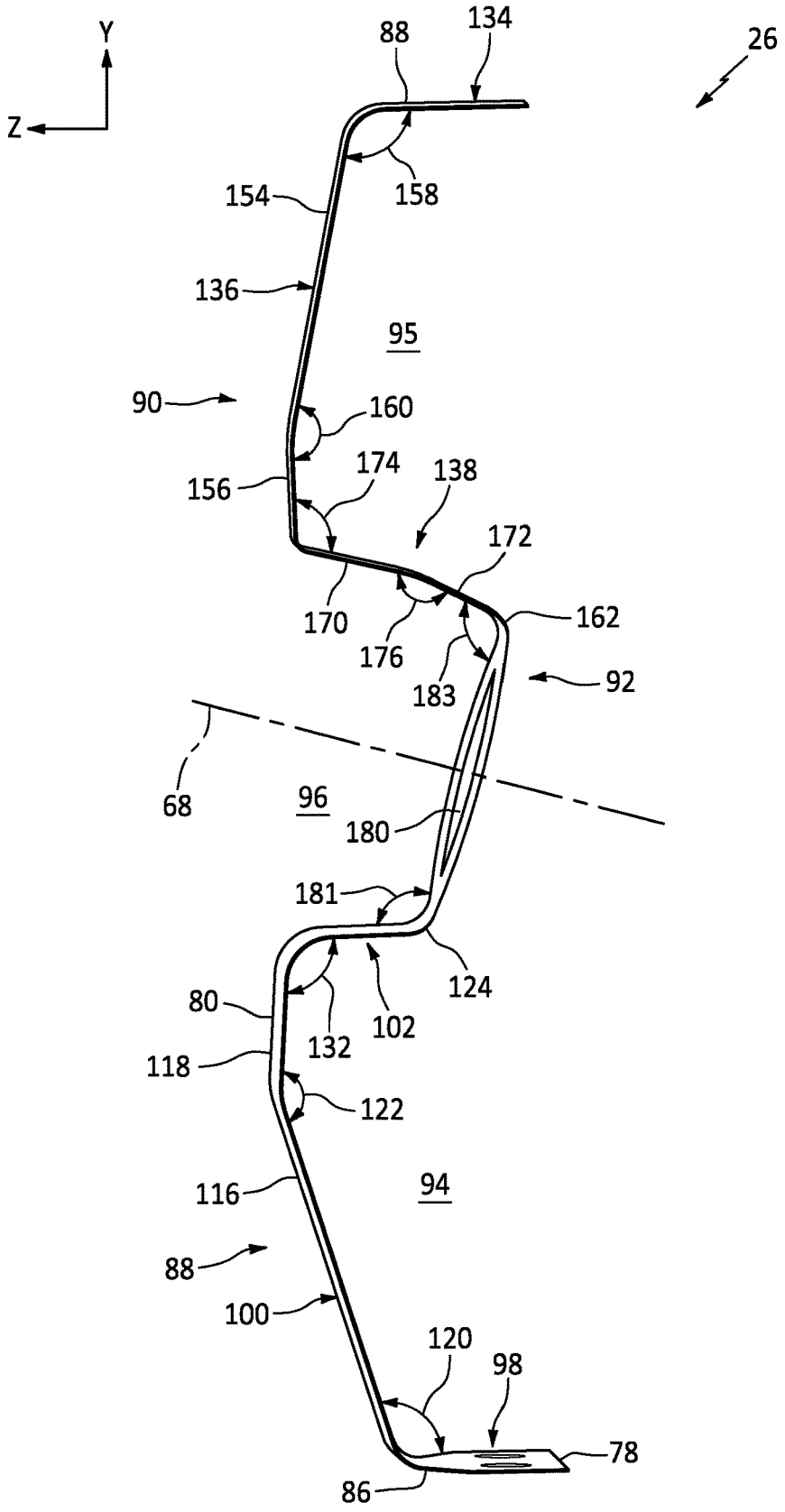

The conduit bracket 26 of FIGS. 4-6 includes one or more bracket fingers 88 and 90 and a conduit mount 92. The conduit bracket 26 may be configured with a generally M-shaped (or W-shaped) sectional geometry when viewed, for example, in a plane parallel with and/or coincident with the longitudinal centerline 68; e.g., the plane of FIG. 6. The conduit bracket 26 of FIG. 6, for example, is configured with one or more channels 94-96.

The first (e.g., forward, upstream) bracket finger 88 of FIGS. 4-6 includes a first base mount 98, a first bridge (e.g., lateral) leg 100 and a first offset (e.g., longitudinal) leg 102. The first base mount 98 may be substantially planar. The first base mount 98 is disposed at the bracket first (e.g., forward, upstream) end 86. The first base mount 98 is connected to an exterior end of the first bridge leg 100, and projects longitudinally (e.g., radially inward towards the axial centerline 48) to a distal end of the conduit bracket 26 and its first base mount 98. The first base mount distal end of FIG. 6 is located at the bracket inner side 78. The first base mount 98 of FIG. 7 has a lateral width 104 that extends laterally along the x-axis between the opposing lateral sides 82 and 84 of the conduit bracket 26.

Figure 7:
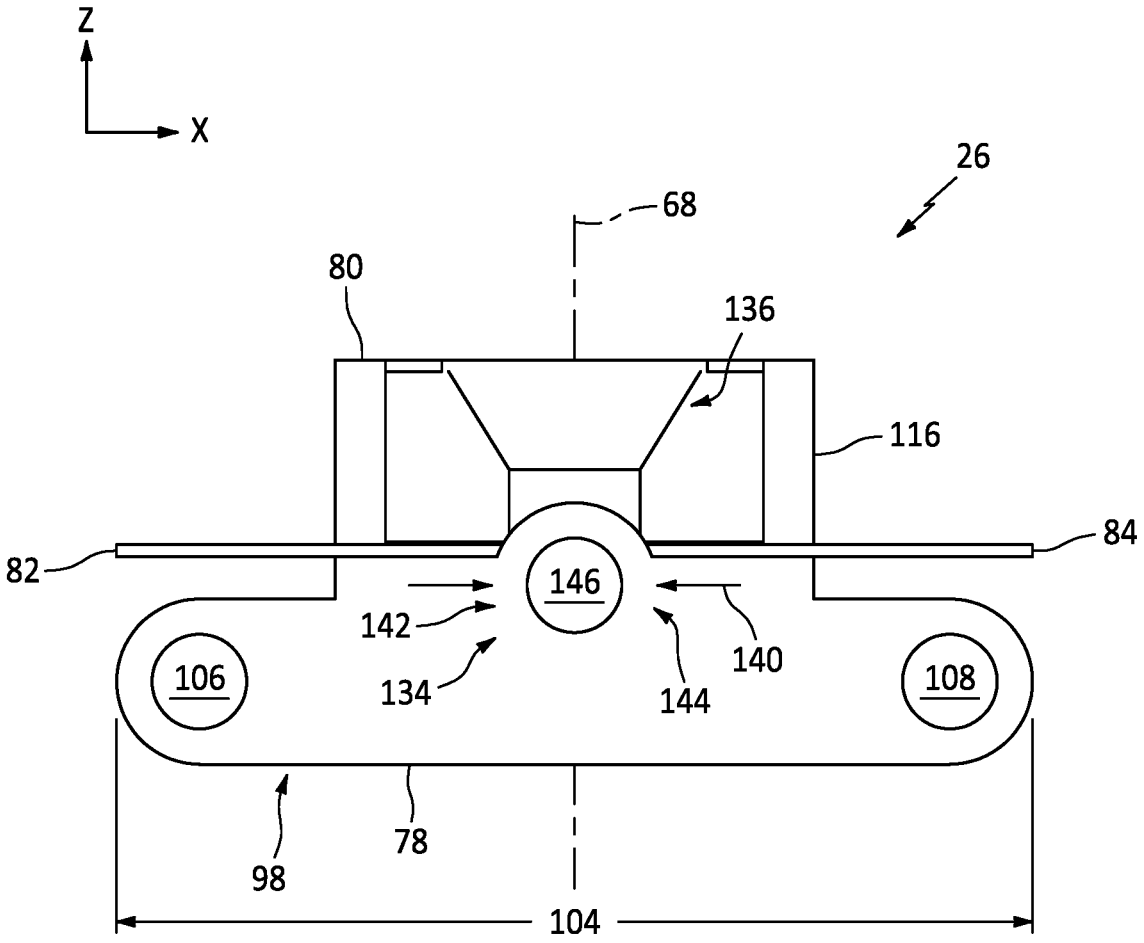

The first base mount 98 of FIG. 7 includes one or more mounting apertures 106 and 108; e.g., fastener apertures such as bolt holes or any other type of through-holes. The first mounting aperture 106 is disposed at the bracket first side 82, and the second mounting aperture 108 is disposed at the bracket second side 84. Each of the mounting apertures 106, 108 extends laterally along the y-axis though the first base mount 98.

The first bridge leg 100 of FIG. 4-6 extends laterally along the y-axis between and to the first base mount 98 and the first offset leg 102. The first bridge leg 100 is connected to the first base mount 98 and the first offset leg 102. The first bridge leg 100 of FIG. 5 has a lateral width 110 that extends laterally along the x-axis between opposing lateral sides 112 and 114 of the first bridge leg 100. The first side 112 of the first bridge leg 100 of FIG. 5 is laterally recessed along the x-axis from the bracket first side 82. The second side 114 of the first bridge leg 100 of FIG. 5 is laterally recessed along the x-axis from the bracket second side 84. The first bridge leg lateral width 110 is thereby smaller than the first base mount lateral width 104. The present disclosure, however, is not limited to such an exemplary embodiment.

The first bridge leg 100 of FIG. 6 includes a first exterior segment 116 and a first interior segment 118. The first exterior segment 116 extends laterally (e.g., along the y-axis) between and to the first base mount 98 and the first interior segment 118. The first exterior segment 116 is connected to the first base mount 98 and the first interior segment 118. The first exterior segment 116 of FIG. 6 is angularly offset from the first base mount 98 by an included angle 120. This included angle 120 may be an obtuse angle. The included angle 120, for example, may be greater than ninety degrees (90°) and less than one-hundred and fifty degrees (150°). The present disclosure, however, is not limited to such an exemplary configuration. For example, the included angle 120 may alternatively be a right angle (90°) or an acute angle depending upon the specific conduit bracket application.

The first interior segment 118 extends laterally along the y-axis between and to the first exterior segment 116 and the first offset leg 102. The first interior segment 118 is connected to the first exterior segment 116 and the first offset leg 102. The first interior segment 118 of FIG. 6 is angularly offset from the first exterior segment 116 by an included angle 122. This included angle 122 may be an obtuse angle. The included angle 122, for example, may be greater than one-hundred and twenty degrees (120°) and less than one-hundred and eighty degrees (180°). The present disclosure, however, is not limited to such an exemplary configuration.

The first offset leg 102 of FIGS. 4 and 6 extends longitudinally along the z axis between and to the first bridge leg 100 and its first interior segment 118, and a first side 124 of the conduit mount 92. The first offset leg 102 may longitudinally overlap and/or be parallel with the first base mount 98. The first offset leg 102 is connected to the first bridge leg 100 and its first interior segment 118, and the mount first side 124. The first offset leg 102 of FIG. 5 has a lateral width 126 that extends laterally along the x-axis between opposing lateral sides 128 and 130 of the first offset leg 102. The first side 128 of the first offset leg 102 is laterally recessed along the x-axis from the bracket first side 82. The second side 130 of the first offset leg 102 is laterally recessed along the x-axis from the bracket second side 84. The first offset leg lateral width 126 is thereby smaller than the first base mount lateral width 104, and may be equal to (or different than) the first bridge leg lateral width 110. The present disclosure, however, is not limited to such an exemplary embodiment.

The first offset leg 102 of FIG. 6 is angularly offset from the first interior segment 118 by an included angle 132. This included angle 132 may be a right angle (90°). The present disclosure, however, is not limited to such an exemplary configuration. For example, the included angle 132 may alternatively be an acute angle (e.g., <90° and/or >45°) or an acute angle (e.g., <135° and/or >90°) depending upon the specific conduit bracket application; e.g., the included angle 132 may be between seventy degrees (70°) and one-hundred and ten degrees (110°).

With the foregoing configuration, the first bracket finger 88 has a channeled sectional geometry when viewed, for example, in a plane parallel with and/or coincident with the longitudinal centerline 68. The first bracket finger 88 thereby forms the first side channel 94. This first side channel 94 extends longitudinally in a (e.g., longitudinal) first direction partially into the first bracket finger 88 from the bracket inner side 78 to the first bridge leg 100, which first direction may be a radial outward direction relative to the axial centerline 48. The first side channel 94 extends laterally along the y-axis within the first bracket finger 88 between and to the first base mount 98 and the first offset leg 102. The first side channel 94 extends laterally along the x-axis (e.g., completely) through the conduit bracket 26 and its first bracket finger 88.

The first bracket finger 88 may also form a (e.g., spring) first damper. This first damper may be tuned by adjusting a thickness of the first bracket finger 88, the dimensions (e.g., widths) of any one or more of its components 98, 100 and 102, and/or any one or more of its angles 120, 122 and 132.

The second (e.g., aft, downstream) bracket finger 90 of FIGS. 4-6 includes a second base mount 134, a second bridge (e.g., lateral) leg 136 and a second offset (e.g., longitudinal) leg 138. The second base mount 134 may be substantially planar. The second base mount 134 is disposed at the bracket second (e.g., aft, downstream) end 88. The second base mount 134 is connected to an exterior end of the second bridge leg 136, and projects longitudinally (e.g., radially inward towards the axial centerline 48) to a distal end of the conduit bracket 26 and its second base mount 134. The second base mount distal end of FIG. 6 is located towards the bracket inner side 78. The second base mount 134 of FIG. 7 has a lateral width 140 that extends laterally along the x-axis between opposing lateral sides 142 and 144 of the second base mount 134. The first side 142 of the second base mount 134 of FIG. 5 is laterally recessed along the x-axis from the bracket first side 82. The second side 144 of the second base mount 134 of FIG. 5 is laterally recessed along the x-axis from the bracket second side 84. The second base mount lateral width 140 is thereby smaller than the first base mount lateral width 104. The second base mount lateral width 140 may also be smaller than the lateral widths 110 and/or 126. The present disclosure, however, is not limited to such an exemplary embodiment.

The second base mount 134 of FIG. 7 includes at least one mounting aperture 146; e.g., fastener aperture such as a bolt hole or any other type of through-hole. The mounting aperture 146 is disposed laterally (e.g., midway) along the x-axis between the second base mount sides 142 and 144. The mounting aperture 146 extends laterally along the y-axis though the second base mount 134.

The second bridge leg 136 of FIG. 4-6 extends laterally along the y-axis between and to the second base mount 134 and the second offset leg 138. The second bridge leg 136 is connected to the second base mount 134 and the second offset leg 138. The second bridge leg 136 of FIG. 5 has a lateral width 148 that extends laterally along the x-axis between opposing lateral sides 150 and 152 of the second bridge leg 136. The first side 150 of the second bridge leg 136 of FIG. 5 is laterally recessed along the x-axis from the bracket first side 82. The second side 152 of the second bridge leg 136 of FIG. 5 is laterally recessed along the x-axis from the bracket second side 84. The second bridge leg lateral width 148 is thereby smaller than the first base mount lateral width 104. The second bridge leg lateral width 148 may also be smaller than the lateral widths 110 and/or 126. The present disclosure, however, is not limited to such an exemplary embodiment.

The second bridge leg 136 of FIG. 6 includes a second exterior segment 154 and a second interior segment 156. The second exterior segment 154 extends laterally along the y-axis between and to the second base mount 134 and the second interior segment 156. The second exterior segment 154 is connected to the second base mount 134 and the second interior segment 156. The second exterior segment 154 of FIG. 6 is angularly offset from the second base mount 134 by an included angle 158. This included angle 158 may be an obtuse angle. The included angle 158, for example, may be greater than ninety degrees (90°) and less than one-hundred and fifty degrees (150°). The present disclosure, however, is not limited to such an exemplary configuration. For example, the included angle 158 may be a right angle (90°) or an acute angle depending upon the specific conduit bracket application.

The second interior segment 156 extends laterally along the y-axis between and to the second exterior segment 154 and the second offset leg 138. The second interior segment 156 is connected to the second exterior segment 154 and the second offset leg 138. The second interior segment 156 of FIG. 6 is angularly offset from the second exterior segment 154 by an included angle 160. This included angle 160 may be an obtuse angle. The included angle 160, for example, may be greater than one-hundred and twenty degrees (120°) and less than one-hundred and eighty degrees (180°). The present disclosure, however, is not limited to such an exemplary configuration.

The second offset leg 138 of FIGS. 4 and 6 extends longitudinally along the longitudinal centerline 68 (and the z-axis) between and to the second bridge leg 136 and its second interior segment 156, and a second side 162 of the conduit mount 92. The second offset leg 138 may longitudinally overlap and/or may be non-parallel with the second base mount 134. The second offset leg 138 is connected to the second bridge leg 136 and its second interior segment 156, and the mount second side 162. The second offset leg 138 of FIG. 5 has a lateral width 164 that extends laterally along the x-axis between opposing lateral sides 166 and 168 of the second offset leg 138. The first side 166 of the second offset leg 138 of FIG. 5 is laterally recessed along the x-axis from the bracket first side 82. The second side 168 of the second offset leg 138 of FIG. 5 is laterally recessed along the x-axis from the bracket second side 84. The second offset leg lateral width 164 is greater than the second base mount lateral width 140, and may be equal to (or different than) the second bridge leg lateral width 148. The second offset leg lateral width 164 may be less than the lateral widths 110 and/or 126. The present disclosure, however, is not limited to such an exemplary embodiment.

The second offset leg 138 of FIGS. 4 and 6 includes an outer segment 170 and an inner segment 172. The outer segment 170 extends longitudinally along the longitudinal centerline 68 (and the z-axis) between and to the second bridge leg 136 and its second interior segment 156, and the inner segment 172. The outer segment 170 is connected to the second bridge leg 136 and its second interior segment 156, and the inner segment 172. The outer segment 170 of FIG. 6 is angularly offset from the second interior segment 156 by an included angle 174. This included angle 174 may be an obtuse angle. The included angle 174, for example, may be greater than ninety degrees (90°) and less than one-hundred and fifty degrees (150°). The present disclosure, however, is not limited to such an exemplary configuration. For example, the included angle 174 may alternatively be a right angle (90°) or an acute angle depending upon the specific conduit bracket application.

The inner segment 172 extends longitudinally along the longitudinal centerline 68 (and the z-axis) between and to the outer segment 170 and the mount second side 162. The inner segment 172 is connected to the outer segment 170 and the mount second side 162. The inner segment 172 of FIG. 6 is angularly offset from the outer segment 170 by an included angle 176. This included angle 176 may be an obtuse angle. The included angle 176, for example, may be greater than one-hundred and twenty degrees (120°) and less than one-hundred and eighty degrees (180°). The present disclosure, however, is not limited to such an exemplary configuration.

With the foregoing configuration, the second bracket finger 90 has a channeled sectional geometry when viewed, for example, in the plane parallel with and/or coincident with the longitudinal centerline 68. The second bracket finger 90 thereby forms the second side channel 95. This second side channel 95 extends longitudinally in the first direction partially into the second bracket finger 90 from the bracket inner side 78 to the second bridge leg 136. The second side channel 95 extends laterally along the y-axis within the second bracket finger 90 between and to the second base mount 134 and the second offset leg 138. The second side channel 95 extends laterally along the x-axis (e.g., completely) through the conduit bracket 26 and its second bracket finger 90.

The second bracket finger 90 may also form a (e.g., spring) second damper. This second damper may be tuned by adjusting a thickness of the second bracket finger 90, the dimensions (e.g., widths) of any one or more of its components 134, 136 and 138, and/or any one or more of its angles 158, 160, 174 and 176.

The conduit mount 92 of FIGS. 4-6 is arranged laterally along the y-axis between the first bracket finger 88 and the second bracket finger 90. The conduit mount 92 is connected to the first bracket finger 88 and the second bracket finger 90. More particularly, the conduit mount 92 of FIGS. 4-6 extends between and is connected to an inner end of the first offset leg 102 and an inner end of the second offset leg 138 and its inner segment 172. The conduit mount 92 of FIG. 5 has a lateral width 178 that extends laterally along the x-axis between the mount lateral sides 82 and 84. The conduit mount lateral width 178 may thereby be equal to the first base mount lateral width 104. The conduit mount lateral width 178 may also be greater than one or more of the lateral widths 110, 126, 140, 148 and/or 164. The present disclosure, however, is not limited to such an exemplary embodiment.

The conduit mount 92 of FIG. 6 is angularly offset from the first offset leg 102 by an included angle 181. The conduit mount 92 is angularly offset from the second offset leg 138 and its inner segment 172 by an included angle 183. The included angle 181 and/or 183 may be an obtuse angle. The included angle 181 and/or 183, for example, may be greater than ninety degrees (90°) and less than one-hundred and fifty degrees (150°). The present disclosure, however, is not limited to such an exemplary configuration. For example, the included angle 181 and/or 183 may alternatively be a right angle (90°) or an acute angle depending upon the specific conduit bracket application. The conduit mount 92 may be angularly offset from the base mount 98 and/or 134 by an acute or obtuse angle. Of course, in other embodiments, the conduit mount 92 may be perpendicular to the base mount 98 and/or 134.

The conduit mount 92 of FIG. 5 includes a conduit mount port 180; e.g., an aperture such as a through-hole. This conduit mount port 180 extends longitudinally along the longitudinal centerline 68 through the conduit mount 92. The conduit mount port 180 may have a round (e.g., circular, elliptical, etc.) cross-sectional geometry, a polygonal (e.g., square, rectangular, etc.) cross-sectional geometry, or a combination thereof such as a polygonal cross-sectional geometry with rounded corners (e.g., a rounded-square). The conduit mount 92 of FIG. 5 also includes one or more mounting apertures 182 and 184; e.g., fastener apertures such as bolt holes or any other type of through-holes. These mounting apertures 182 and 184 are arranged on opposing lateral sides along the x-axis of the conduit mount port 180. Each of the mounting apertures 182, 184 extends longitudinally through the conduit mount 92.

Referring to FIG. 6, with the foregoing configuration, the bracket components 88, 90 and 92 form the intermediate channel 96 laterally along the y-axis between the bracket fingers 88 and 90. This intermediate channel 96 extends longitudinally in a (e.g., longitudinal) second direction partially into the conduit bracket 26 from the bracket outer side 80 to the conduit mount 92, which second direction may be a radial inward direction relative to the axial centerline 48, opposite the first direction. The intermediate channel 96 extends laterally along the y-axis within the conduit bracket 26 between and to the first offset leg 102 and the second offset leg 138. The intermediate channel 96 extends laterally along the x-axis (e.g., completely) through the conduit bracket 26.

The conduit bracket 26 of FIGS. 4-6 may be configured as a monolithic body. At least the conduit bracket components 88, 90 and 92, for example, may be formed together as a single, unitary body. The conduit bracket 26, for example, may be formed from a shaped and bent piece of sheet metal. In another example, the conduit bracket 26 may be machined form a lump mass of material; e.g., metal. The present disclosure, however, is not limited to the foregoing exemplary formation techniques nor conduit bracket materials. The conduit bracket 26, for example, may also or alternatively be formed from a polymer and/or a composite material. Furthermore, in other embodiments, any two or more of the conduit bracket components (e.g., 88, 90 and 92) may be discretely formed and then attached together to provide the conduit bracket 26 with a non-monolithic body.

Referring to FIG. 2, the conduit bracket 26 is connected to the static structure 22. The conduit bracket 26, for example, is arranged laterally along the y-axis between the structure mounts 34 and 36. The first base mount 98 is attached (e.g., mechanically fastened) to the first structure mount 34. Fasteners 186 and 188 (e.g., bolts) (see also FIG. 1), for example, may project respectively through the mounting apertures 106 and 108 (see FIG. 7) and mounting apertures in the first structure mount 34, and may be secured with nuts (e.g., see 192 in FIG. 1). The second base mount 134 is attached (e.g., mechanically fastened) to the second structure mount 36. A fastener 194 (e.g., a bolt), for example, may project through the mounting aperture 146 (see FIG. 7) and a mounting aperture in the second structure mount 36, and may be secured with a nut 196. The conduit bracket 26 and each of its bracket fingers 88 and 90 may thereby be securely fixed to the static structure 22.

Referring to FIGS. 1 and 2, the fluid conduit 24 passes longitudinally through the conduit mount port 180 along the longitudinal centerline 68. The conduit fixture 28 on the fluid conduit 24 may be connected (e.g., mechanically fastened) to the conduit mount 92. For example, referring to FIG. 1, fasteners 198 and 200 (e.g., bolts) may respectively project longitudinally through mounting apertures in the conduit fixture 28 and the mounting apertures 182 and 184 (see FIG. 5) in the conduit mount 92. The fluid conduit 24 and its conduit fixture 28 may thereby be fixedly secured to the conduit mount 92.

Figure 8:
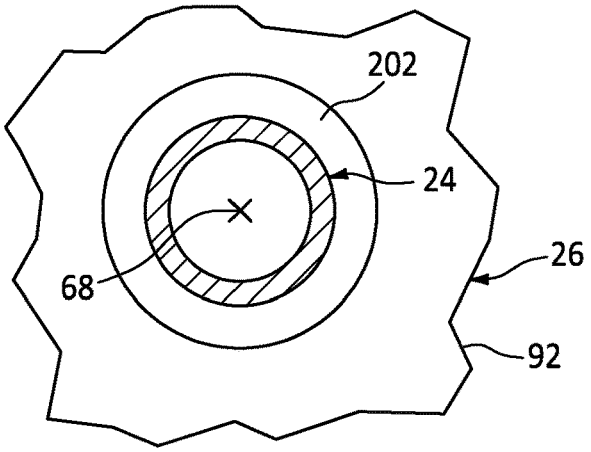
FIG. 8 is an illustration of an interface between a fluid conduit and the conduit bracket.

In some embodiments, referring to FIG. 8, an annular gap 202 may be formed between and thereby (e.g., completely) separate the fluid conduit 24 and the conduit bracket 26 and its conduit mount 92.

In some embodiments, the first bracket finger 88 may have a different configuration than the second bracket finger 90 as described above. In other embodiments, each of the bracket fingers 88 and 90 may have the same (or a similar) configuration. Each of the bracket fingers 88 and 90, for example, may be configured like the first bracket finger 88 described above, or the second bracket finger 90 described above.

Figure 9:
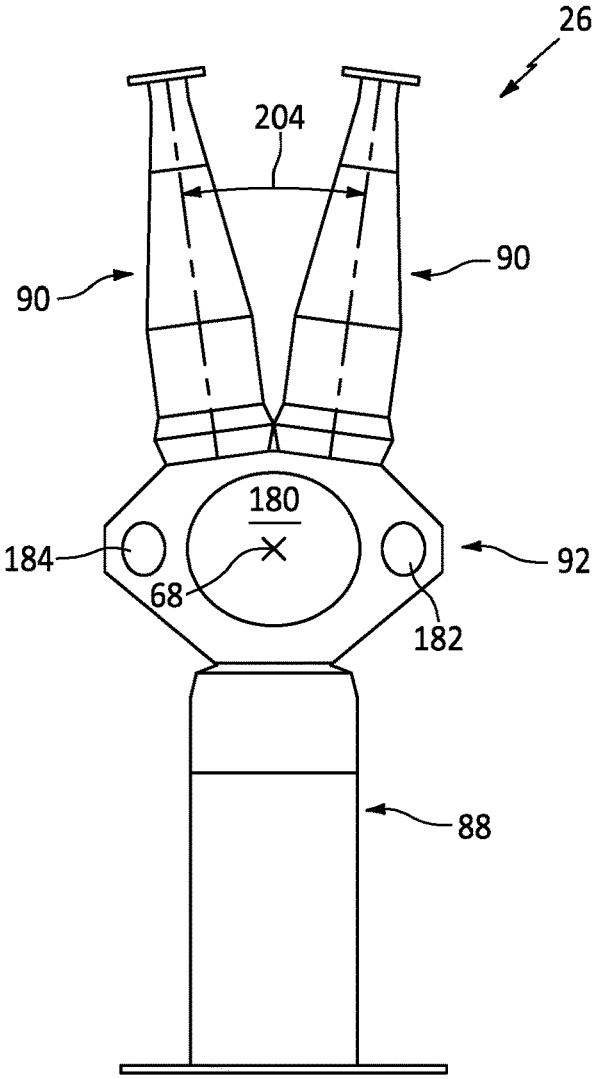
FIG. 9 is an illustration of the conduit bracket configured with an additional bracket finger.

In some embodiments, referring to FIG. 9, the conduit bracket 26 may include more than two bracket fingers (e.g., 88 and/or 90) and/or dampers. The conduit bracket 26 of FIG. 9, for example, includes a pair of the second bracket fingers 90 to couple the conduit mount 92 to the second structure mount 36 (see FIG. 2). These second bracket fingers 90 may be angularly offset from one another by an included angle 204; e.g., an acute angle.

Figure 10:
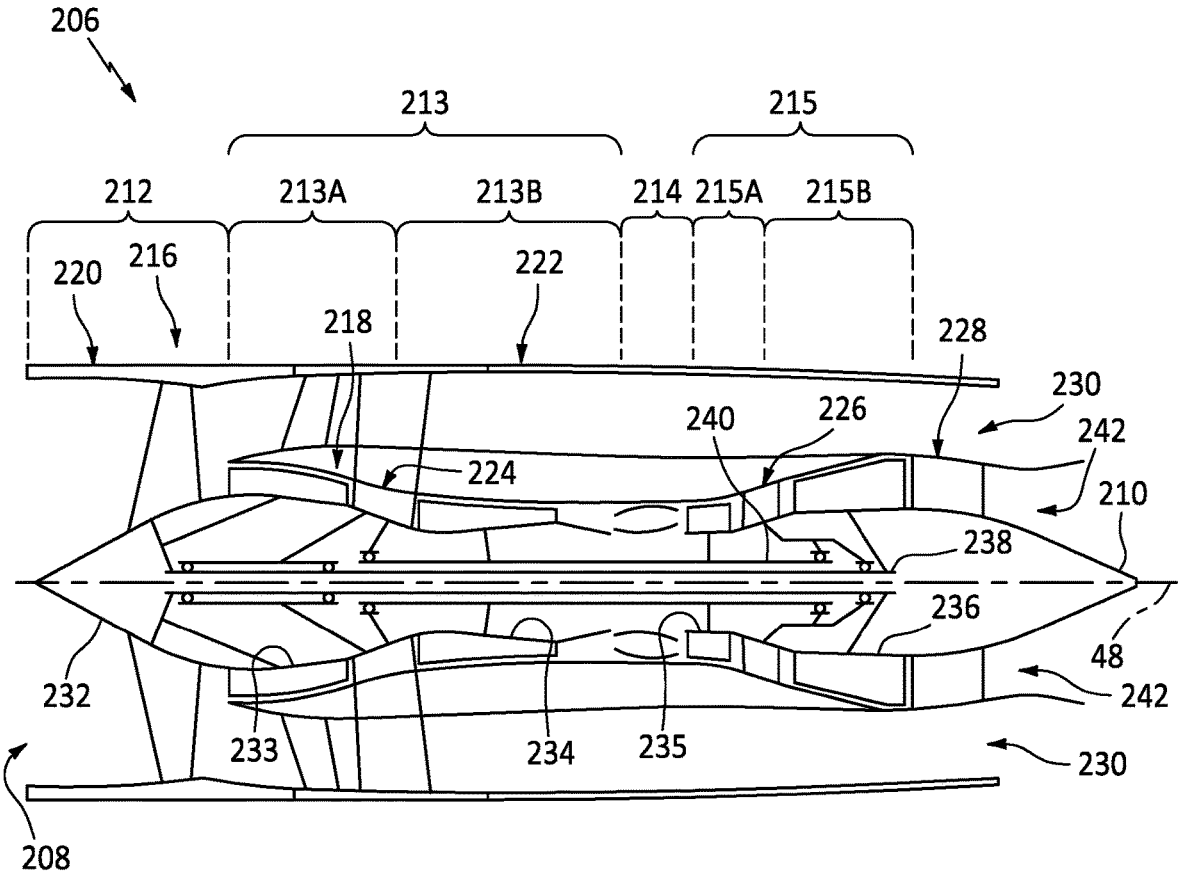
FIG. 10 is a schematic, side sectional illustration of a gas turbine engine.

FIG. 10 is a side sectional illustration of a turbofan gas turbine engine 206, which turbine engine 206 may include the turbine engine assembly 20 described above. This turbine engine 206 extends along the axial centerline 48 between an upstream airflow inlet 208 and a downstream exhaust center body 210. The turbine engine 206 includes a fan section 212, a compressor section 213, a combustor section 214 and a turbine section 215. The compressor section 213 includes a low pressure compressor (LPC) section 213A and a high pressure compressor (HPC) section 213B. The turbine section 215 includes a high pressure turbine (HPT) section 215A and a low pressure turbine (LPT) section 215B.

The engine sections 212-215B are arranged sequentially along the axial centerline 48 within an engine housing 216. The engine housing 216 includes an inner housing structure 218, an outer housing structure 220 and a bypass duct 222. The inner housing structure 218 is configured to house and/or support one or more components of a core of the turbine engine 206, which engine core includes the compressor section 213, the combustor section 214 and the turbine section 215. The inner housing structure 218 may include a compressor support structure 224 (e.g., a mid-compressor frame), a turbine support structure 226 (e.g., a mid-turbine frame) and a turbine exhaust case 228 (TEC), where any of these components 224, 226, 228 may be configured as the static structure 22 of FIG. 1. The outer housing structure 220 is configured to house and/or support the fan section 212 and the engine core. The bypass duct 222 is configured to form a (e.g., annular) bypass flowpath 230 that provides a bypass around (e.g., radially outside of and axially along) the engine core.

Each of the engine sections 212, 213A, 213B, 215A and 215B includes a respective rotor 232-236. Each of these rotors 232-236 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 232 and the LPC rotor 233 are connected to and driven by the LPT rotor 236 through a low speed shaft 238. The HPC rotor 234 is connected to and driven by the HPT rotor 235 through a high speed shaft 240. These engine shafts 238 and 240 (e.g., rotor drive shafts) are rotatably supported by a plurality of bearings. Each of these bearing is connected to the engine housing 216 by at least one static support structure.

During operation of the turbine engine 206 of FIG. 10, air enters the turbine engine 206 through the airflow inlet 208. This air is directed through the fan section 212 and into a (e.g., annular) core flowpath 242 and the bypass flowpath 230. The core flowpath 242 extends sequentially through the engine sections 213A-215B. The air within the core flowpath 242 may be referred to as "core air". The air within the bypass flowpath 230 may be referred to as "bypass air".

The core air is compressed sequentially by the LPC rotor 233 and the HPC rotor 234, and directed into a combustion chamber of a combustor in the combustor section 214. Fuel is injected into the combustion chamber and mixed with the compressed core air to provide a fuel-air mixture. This fuel air mixture is ignited and combustion products thereof flow through and sequentially cause the HPT rotor 235 and the LPT rotor 236 to rotate. The rotation of the HPT rotor 235 and the LPT rotor 236 respectively drive rotation of the HPC rotor 234 and the LPC rotor 233 and, thus, compression of the air received from a core flowpath inlet. The rotation of the LPT rotor 236 also drives rotation of the fan rotor 232, which propels bypass air through and out of the bypass flowpath 230. The propulsion of the bypass air may account for a majority of thrust generated by the turbine engine 206.

The turbine engine assembly 20 may be included in various turbine engines other than the one described above. The turbine engine assembly 20, for example, may be included in a geared turbine engine where a gear train connects one or more shafts to one or more rotors in a fan section, a compressor section and/or any other engine section. Alternatively, the turbine engine assembly 20 may be included in a turbine engine configured without a gear train. The turbine engine assembly 20 may be included in a geared or non-geared turbine engine configured with a single spool, with two spools (e.g., see FIG. 10), or with more than two spools. The turbine engine may be configured as a turbofan engine, a turbojet engine, turboprop engine, a turboshaft engine, a propfan engine, a pusher fan engine, an auxiliary power unit (APU) or any other type of turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:

a static structure of the turbine engine comprising a port;

a conduit extending longitudinally through the port; and a bracket coupling the conduit to the static structure, the bracket comprising:

a first base mount attached to the static structure;

a second base mount attached to the static structure;

a conduit mount mechanically coupled with the conduit;

a first damper between the first base mount and the conduit mount; and a second damper between the second base mount and the conduit mount;

wherein the first damper includes a lateral leg and a longitudinal leg;

wherein the lateral leg extends laterally between and is connected to the first base mount and the longitudinal leg;

wherein the longitudinal leg extends longitudinally between and is connected to the lateral leg and the conduit mount;

wherein the lateral leg includes a first segment and a second segment;

wherein the first segment is connected between the first base mount and the second segment;

wherein the first segment is angularly offset from the first base mount by a first obtuse angle; and wherein the second segment is angularly offset from the first segment by a second obtuse angle.

2. The assembly of claim 1, wherein the static structure includes a turbine engine case through which the port extends;

a first structure mount connected to a base of the turbine engine case, wherein the first base mount is mechanically fastened to the first structure mount; and a second structure mount connected to the base of the turbine engine case, wherein the second base mount is mechanically fastened to the second structure mount.

3. The assembly of claim 2, wherein the first structure mount is configured as a flange of the turbine engine case.

4. The assembly of claim 2, wherein the first structure mount is configured as a boss of the turbine engine case.

5. The assembly of claim 1, wherein the conduit mount comprises a second port; and the conduit projects longitudinally through the second port.

6. The assembly of claim 5, further comprising a conduit fixture fluidly coupled to an end of the conduit, the conduit fixture mechanically fastened to the conduit mount.

7. The assembly of claim 1, wherein the conduit mount is non-perpendicular to the first base mount.

8. The assembly of claim 1, wherein the longitudinal leg longitudinally overlaps the first base mount.

9. The assembly of claim 1, wherein the longitudinal leg is parallel with the first base mount.

10. The assembly of claim 1, wherein the longitudinal leg is non-parallel with the first base mount.

11. The assembly of claim 1, wherein the second segment is angularly offset from the longitudinal leg by an included angle between seventy degrees and one-hundred and ten degrees.

12. An assembly for a turbine engine, comprising:

a static structure of the turbine engine comprising a port;

a conduit extending longitudinally through the port; and a bracket coupling the conduit to the static structure, the bracket comprising:

a first base mount attached to the static structure;

a second base mount attached to the static structure;

a conduit mount mechanically coupled with the conduit;

a first damper between the first base mount and the conduit mount; and a second damper between the second base mount and the conduit mount;

wherein the first damper includes a lateral leg and a longitudinal leg;

wherein the lateral leg extends laterally between and is connected to the first base mount and the longitudinal leg;

wherein the longitudinal leg extends longitudinally between and is connected to the lateral leg and the conduit mount;

wherein the longitudinal leg includes a first segment and a second segment;

wherein the second segment is connected between the conduit mount and the first segment;

wherein the second segment is angularly offset from the conduit mount by a first obtuse angle; and wherein the second segment is angularly offset from the first segment by a second obtuse angle.

13. The assembly of claim 1, wherein at least the first base mount, the second base mount, the conduit mount, the first damper and the second damper are configured together as a monolithic body.

* * * * *